US005704902A

United States Patent [19]

Vandenbelt et al.

[11] Patent Number: 5,704,902

[45] Date of Patent: Jan. 6, 1998

[54] HANDHOLDABLE MASSAGER HAVING COMBINATION MASSAGING AND DUAL FUNCTION TWO SPEED ACTUATOR PAD

[75] Inventors: Rudy Anthony Vandenbelt, Ottawa, Canada; Troy Gene Anderson, Cambridge, Mass.

[73] Assignee: Headwaters Research & Development Inc, Ottawa, Canada

[21] Appl. No.: 530,417

[22] Filed: Sep. 19, 1995

[51] Int. Cl.[6] ..... A61H 1/00

[52] U.S. Cl. ..... 601/72; 601/46; 601/70; 601/69

[58] Field of Search ..... 601/70–74, 78–81, 601/46, 48, 67, 68, 69, 84

[56] References Cited

U.S. PATENT DOCUMENTS

| | | | |
|---|---|---|---|
| 2,193,978 | 7/1940 | Miller | 601/80 |
| 2,661,736 | 8/1953 | Schwartz | 601/80 |
| 3,375,381 | 3/1968 | Tavel | 601/70 |
| 3,549,920 | 12/1970 | Tavel | 601/70 |
| 4,559,929 | 12/1985 | Hseu | 601/70 |
| 5,264,821 | 11/1993 | Vultaggio et al. | 338/172 |
| 5,520,616 | 5/1996 | Hofmeister | 601/70 |

*Primary Examiner*—Robert A. Hafer
*Assistant Examiner*—Benjamin Koo
*Attorney, Agent, or Firm*—Albert Peter Durigon

[57] ABSTRACT

A handholdable massager having a combination massaging and dual function two speed actuator pad is disclosed which provides both automatic and manual modes of operation enabling a user to enjoy either a hands-free or user-applied massage to almost any body part at user-selectable speeds. The combination massaging and actuator pad, mounted in the presently preferred embodiment for rotation and translation with a handholdable housing body, both vibrates as well as provides the control action to select the manual and the automatic modes of operation at different speeds, simply by rotating and translating it about its axis of rotation. An actuation mechanism having two (2) switches and actuator cams integrally formed with the combination massaging and actuator pad cooperate in the presently preferred embodiment to provide user-selection of the mode and of the speed of operation. The handholdable housing in the presently preferred embodiment has mating top and bottom housing bodies into which a DC motor and two (2) "C" batteries of comparatively light weight are received.

19 Claims, 6 Drawing Sheets

HANDHOLDABLE MASSAGER HAVING COMBINATION MASSAGING AND DUAL FUNCTION TWO SPEED ACTUATOR PAD

FIELD OF THE INVENTION

This invention is drawn to the field of massagers, and more particularly, to a novel handholdable massager having a combination massaging and dual function actuator pad, and still more particularly, to a handholdable massager having a combination massaging and dual function, two speed actuator pad.

BACKGROUND OF THE INVENTION

Hand sized and battery powered massagers having single speed vibratory elements are known to those skilled in the art. One known such device, the Muscle Massager™ device commercially available from the Brookstone, Inc., has a depressible massaging pad that, when depressed (e.g. by "manually" applying pressure thereto), actuates the vibratory element thereof. In typical use, the user needs to manually depress the massaging pad to enable a massage. However, the longer a massage session lasts, the longer the pressure needs to be applied, so that the user is subject to become undesireably fatigued thereby. The pressure-actuated vibratory element thereof also may be subject to unintended, false actuation, which wastes battery power. Due to the portability obtained from the hand sized and battery powered massager, it may readily be transported such as when it is packed in a suitcase, a work-out bag and the rest. However, if packed too tightly or if the contents shift, the pressure-actuated vibratory element would be actuated falsely and therewith its battery power could be unnecessarily depleted.

SUMMARY OF THE INVENTION

Accordingly, it is the principal object of the present invention to disclose a portable handheld massager having a combination massaging and dual function actuator pad that neither is subject to unintended actuation nor is subject to undesirable user fatigue. In accord therewith, a massager having a combination massaging and dual function actuator pad is disclosed which in the presently preferred embodiment allows the user to select an "off" state and one of two modes of operation (dual function), "manual" or "automatic," by simply rotating the combination massaging and actuator pad to preselected first and second angular positions. In the "automatic" angular position of the combination massaging and actuator pad, the massaging pad starts to vibrate when pressure is manually applied thereto. In the "manual" angular position of the combination massaging and actuator pad, the massaging pad starts to vibrate immediately but no pressure is required thereby providing a "hands-free" relaxing massage. Unintended and false actuation are eliminated by transporting the portable massager with its combination massaging and actuator pad set in its "off" angular position and undesirable user fatigue is eliminated by using the portable massager with its combination massaging and actuator pad set in its "manual" angular position.

It is a related object of the present invention to disclose a portable handheld massager having a combination massaging and dual function actuator pad which provides both a massaging and a dual function control action in one. In accord therewith, a portable handheld massager having a combination massaging and dual function actuator pad is disclosed which in the presently preferred embodiment synergistically provides both a massaging and a dual function rotary control action.

It is a related object of the present invention to disclose a portable handheld massager having a combination massaging and dual function multispeed actuator pad that allows the users to select one of at least two (2) different speeds of operation. In accord with the related object of the present invention, a portable handheld massager having a combination massaging and dual function two (2) speed actuator pad is disclosed in the presently preferred embodiment which, in either the "manual" or "automatic" modes of operation (dual functions), enables "low" or "high" speed vibration of the combination massaging and actuator pad by simply rotating the combination massaging and actuator pad to different third and fourth angular positions. Two speed control in either the "manual" or the "automatic" modes of operation thereby allows the users to customize the massage level to their liking by simply rotating the combination massaging and dual function and two (2) speed actuator pad thereof to the desired one of the low and high speed angular positions.

It is yet another related object of the present invention to disclose a portable handheld massager having a combination massaging and dual function two (2) speed actuator pad that further allows for ease of assembly, use and economy of manufacture. In accord therewith, a portable massager having a combination massaging and dual function two (2) speed actuator pad is disclosed which in the presently preferred embodiment is comprised of modular mating top and bottom housing bodies having switch- and vibratory element receiving housing portions integrally formed therewith that are injection molded of a thermoplastic material and of a combination massaging and actuator pad having switch actuating comparatively-high and comparatively-low profile cams integrally formed therewith that are injection molded of a thermoplastic material. The substantially one-piece and mating housing bodies and one-piece combination massaging and dual function two (2) speed actuator pad allow for ease of assembly, use flexibility and economy of manufacture.

BRIEF DESCRIPTION OF THE DRAWINGS

These and other objects, inventive aspects and advantageous features of the present invention will become apparent as the invention becomes better understood by referring to the following detailed description of the presently preferred embodiments thereof and to the drawings, wherein.

DETAILED DESCRIPTION OF THE PREFERRED EMBODIMENTS

Figure 1A:
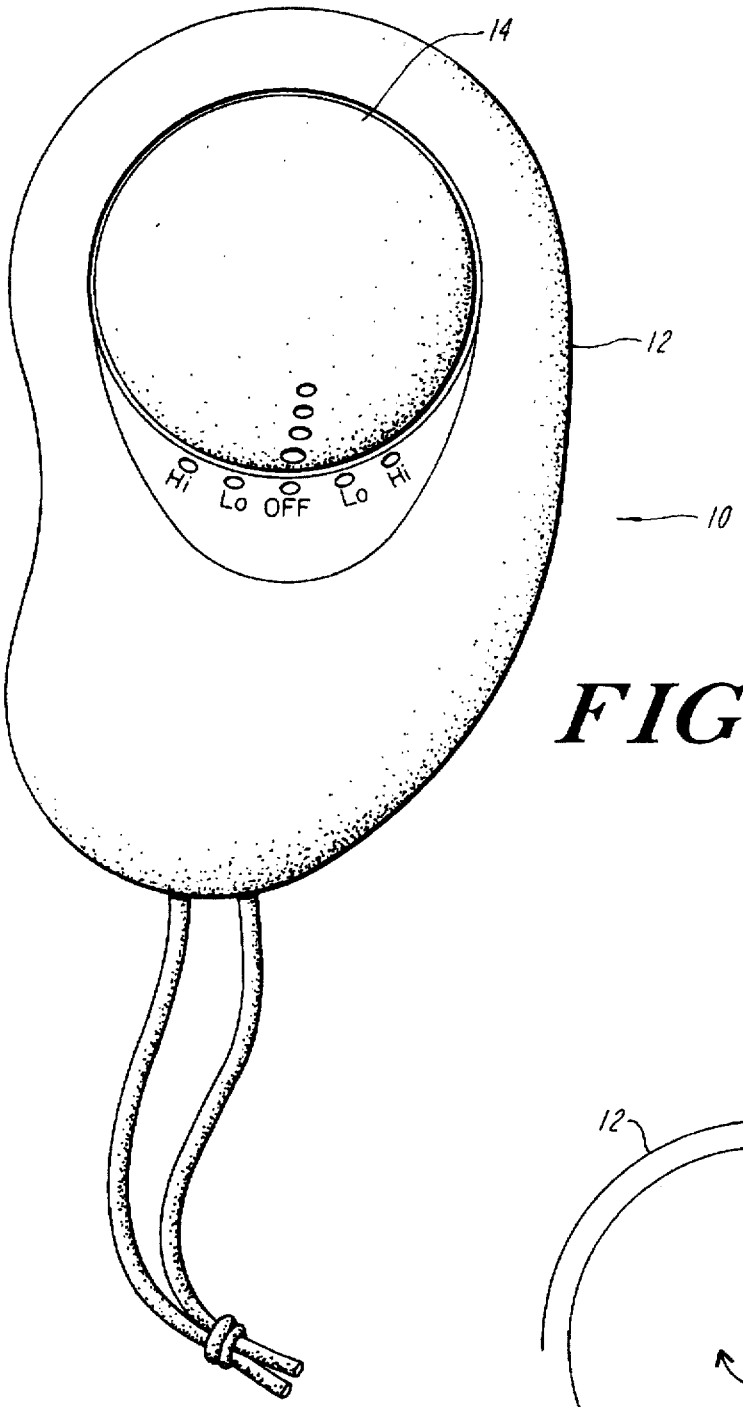
FIG. 1 in the FIG. 1A thereof is a pictorial view and in the FIG. 1B thereof is a diagrammatic view illustrating the portable handheld massager having combination massaging and dual function two speed actuator pad of the present invention that are useful in explaining the presently preferred manner of controlling the operation thereof.
Figure 1B:
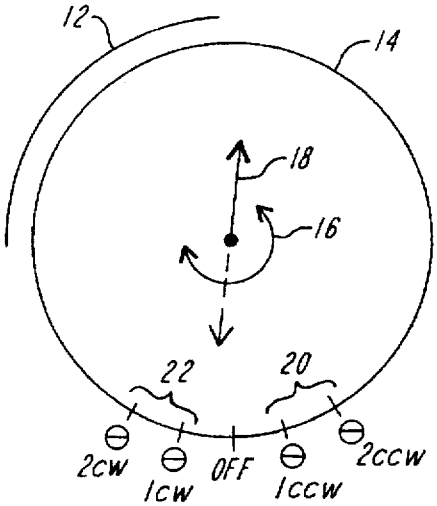

Referring now to FIG. 1, generally designated at 10 in FIG. 1A is a pictorial view illustrating a presently preferred embodiment of the portable hand held massager having a combination massaging and dual function two speed rotating actuator pad of the present invention. The device 10 has a body 12 to be described and a combination massaging and actuator pad 14 to be described. The body 12 is ergonometrically shaped to be comfortably gripped by hand, and it has a thumb-receiving concave contour formed to the left hand side of the illustration, a fingers-receiving convex contour formed to the right hand side of the illustration and a thickness that corresponds to the distance defined by the opposing thumb and fingers of an open hand of an adult. The combination massaging and actuator pad 14, as best seen in FIG. 1B, is mounted in a manner to be described for rotation 16 to the body 12 about an axis of rotation 18 and for translation along the axis of rotation 18.

The combination massaging and actuator pad 14 both vibrates when the device 12 is actuated as well as controllably actuates the device 12 for operation in one of a "manual" mode, where the combination massaging and actuator pad begins to vibrate immediately at user selectable low and high speeds, and an "automatic" mode, where the combination massaging and actuator pad only begins to vibrate at user selectable low and high speeds when pressure is externally applied. When it is rotated about the axis 16 counterclockwise to a selected one of the angular positions marked "lo" and "hi" in FIG. 1A and marked "$\theta_{1ccw}$" "$\theta_{2ccw}$" in FIG. 1B, the device 12 is operable in its "manual" mode as shown by a bracket marked 20 in FIG. 1B. At the corresponding counterclockwise angular position selected, the combination massaging and actuator pad 14 is caused to vibrate in a manner described below at either low or high speed. When it is rotated about the axis 16 clockwise to a selected one of the angular positions marked "lo" and "hi" in FIG. 1A and marked "$\theta_{1cw}$," "$\theta_{2cw}$" in FIG. 1B and pressure is applied along the axis 18 to translate the combination massaging and actuator pad along the axis 18, the device 12 is operable in its "automatic" mode as shown by a bracket marked 22 in FIG. 1B. At the corresponding clockwise angular position selected, the combination massaging and actuator pad 14 is caused to vibrate in a manner described below at either low or high speed as soon as external pressure is applied thereto to depress it along the axis 18. There is provided an "off" angular position of the combination massaging and actuator pad 14 that lies between the angular positions 20, 22 that correspond to the manual and automatic angular positions of the combination massaging and actuator pad 14. It should be noted that although in the preferred embodiment dual function (manual and automatic) and two speed (low and high) control is provided by controllably rotating and translating the combination massaging and actuator pad about the axis 18, more than two functions and/or a greater or lesser number of speeds may be provided by controllably displacing the combination massaging and actuator pad about the same or different axes without departing from the inventive concepts. The combination massaging and actuator pad is an actuator member or member.

Figure 2A:
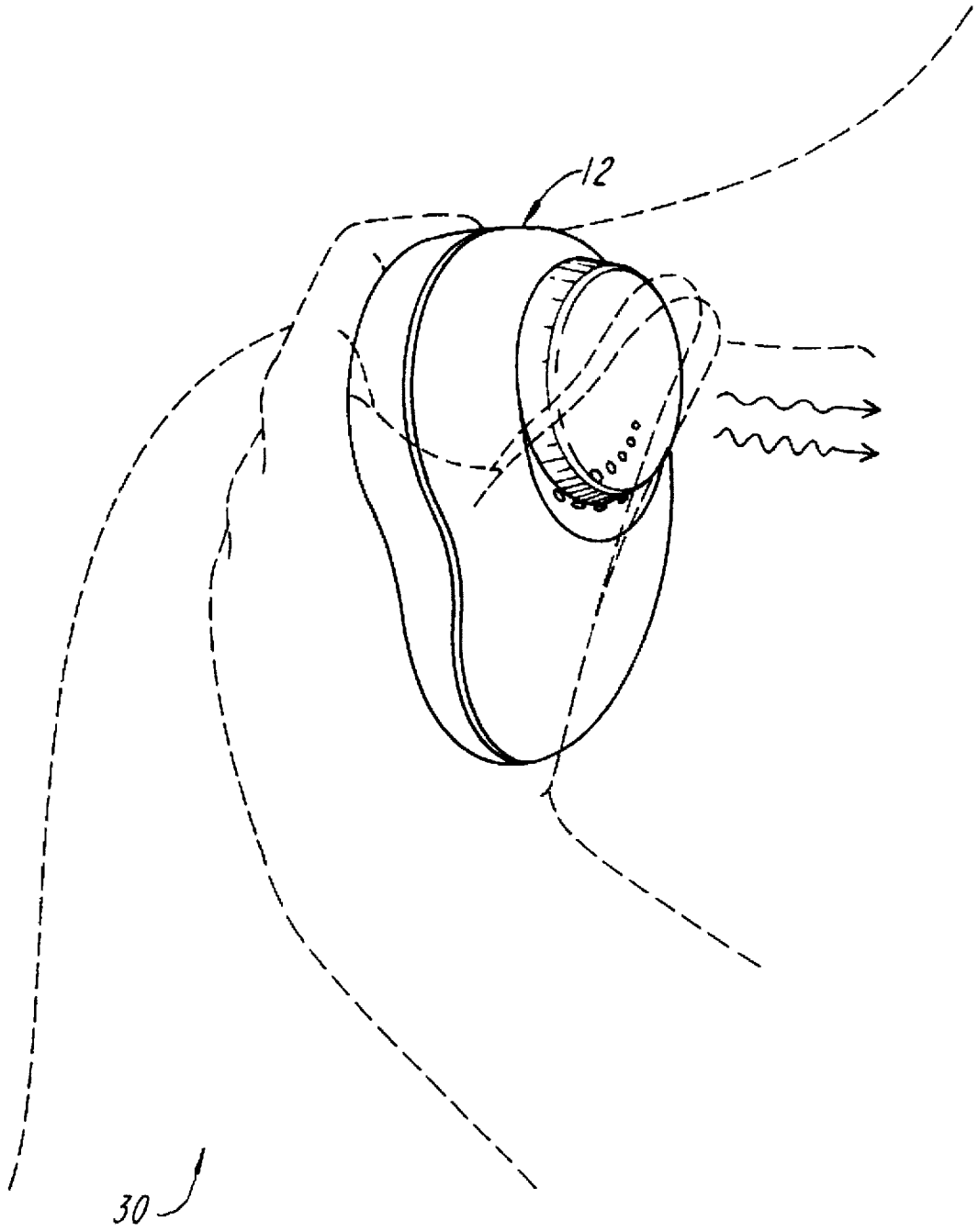
FIG. 2 in the FIGS. 2A, 2B, and 2C thereof are pictorial views of the portable handheld massager having combination massaging and dual function two speed actuator pad of the present invention that are useful in explaining some of the various manners by which it may be used.

With reference to FIG. 2, the flexibility and convenience that synergistically belongs to the handheld massager having a combination massaging and dual function and two speed actuator pad of the presently preferred embodiment will now be described. Generally designated at 30 in FIG. 2A is a pictorial view illustrating the device 12 of the presently preferred embodiment of the invention held in the left hand of a user, with one side of the device 12 against the palm, and with the front and backs thereof seized between the thumb and the forefingers of the user, with the thumb resting on the combination massaging and dual function two speed rotating actuator pad, where the device 12 is shown ready to be placed into contact with the mid-right front shoulder of the user. As can be seen, the thickness of the device 12 is sized to fit comfortably between the fingers and included palm of the user's hand. When the combination massaging and dual function two speed rotating actuator pad 14 is rotated to one of it clockwise angular positions (described above) and is depressed, the user is able to continuously or intermittently impart a soothing, relaxing massage by bringing it into contact with any body part. In the "automatic" mode, as will readily be appreciated, the device of the invention may be situated between a support and the body part to be massaged, not shown, to allow the weight (or pressure) of the body of the user to actuate the device. As illustrated by the arrows of different frequency, the user is able to apply such massaging action to the selected body part at one of high and low speeds.

Figure 2B:
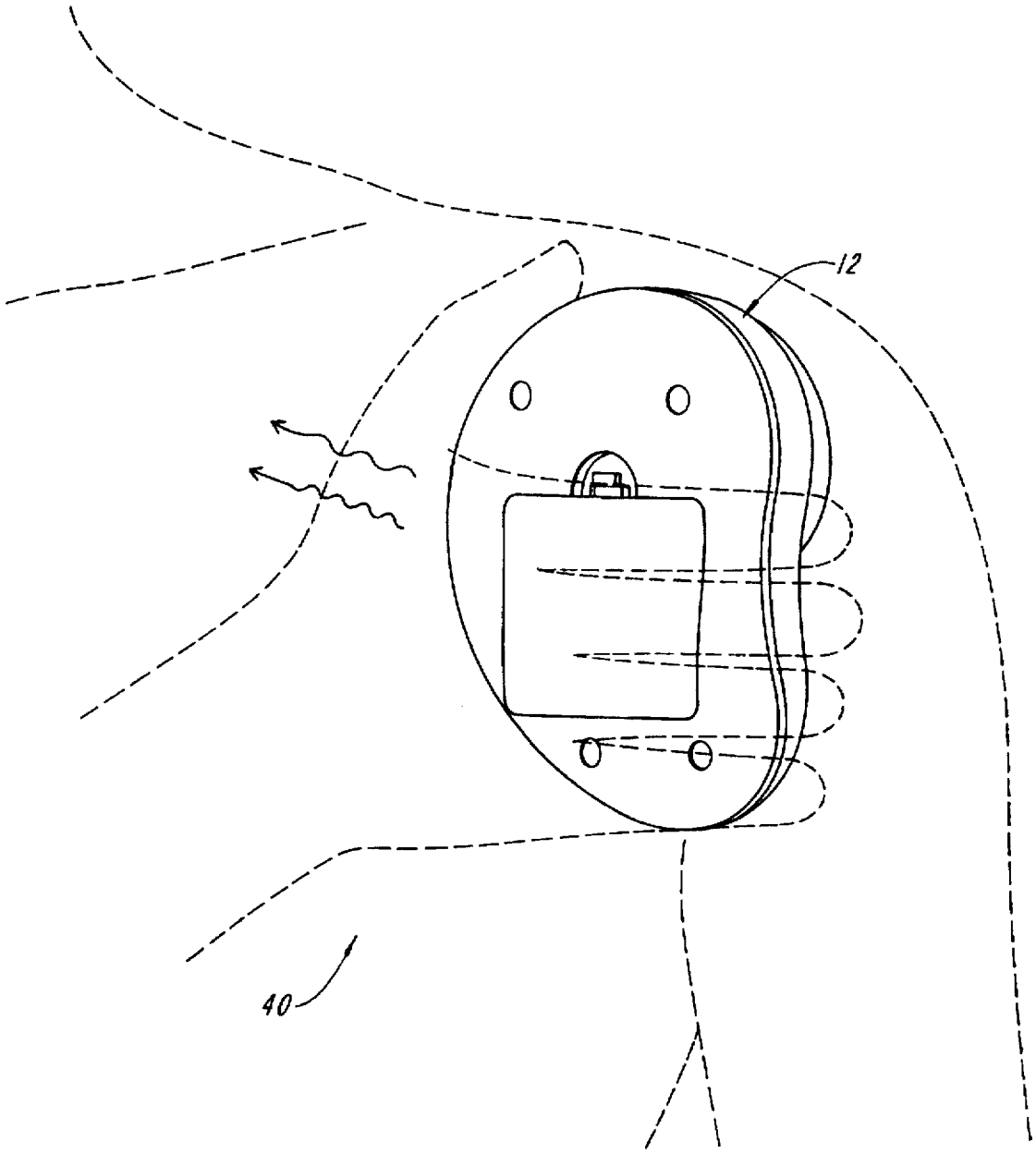

Referring now to FIG. 2B, generally designated at 40 is a pictorial view illustrating the portable hand-held massager having a combination massaging and dual function two speed rotating actuator pad of the presently preferred embodiment of the invention held in the right hand of the user with opposing sides of the device held between the thumb and the opposing fingers, with the back of the device spaced from and generally parallel the plane of the palm of the user. The device 12 is shown held into contact with the left shoulder. As can be seen, the width of the device 12 is sized to fit comfortably between the fingers and opposed fingers of the user's hand. When the combination massaging and dual function two speed rotating actuator pad 14 is rotated to one of it counterclockwise angular positions (described above) for operation in its manual mode, the user is able to impart a soothing, relaxing massage by bringing it into contact with any body part. As illustrated by the arrows of different frequency, the user is able to apply such massaging action to any body part selected at one of high and low speeds, simply by rotating the combination massaging and actuator pad to the desired angular position.

Figure 2C:
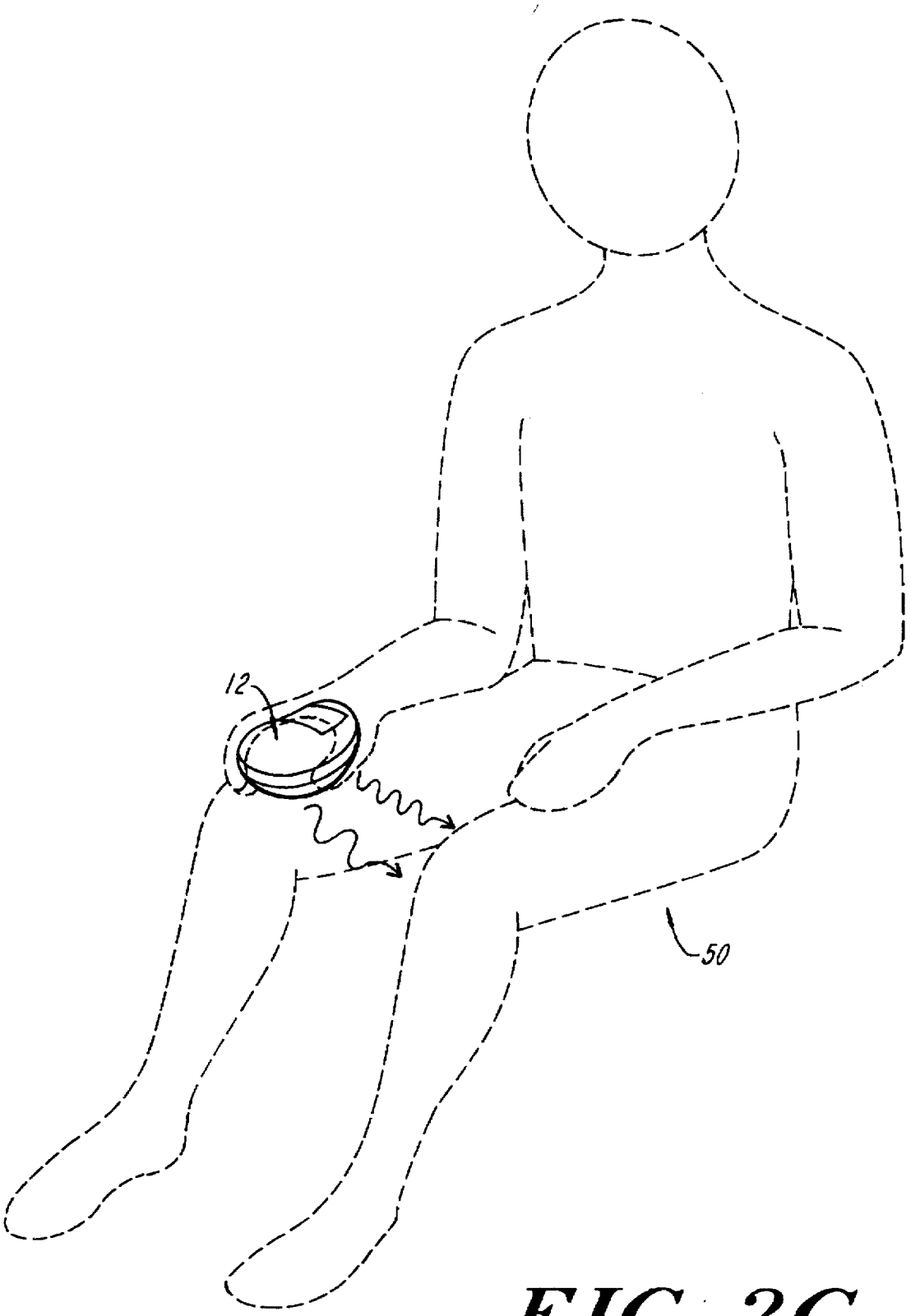

Referring now to FIG. 2C, generally designated 50 is a pictorial view illustrating the hand-held portable massager having combination massaging and dual function two speed rotating actuating pad of the presently preferred embodiment of the invention, where the device is shown supported by the right hand and resting on the right top of the leg of the user. When the combination massaging and dual function two speed rotating actuator pad 14 is rotated to one of it counterclockwise angular positions (described above) for operation in its manual mode, the user is able to impart a soothing, relaxing massage by allowing it to rest on, or by otherwise bringing it into contact with, any body part selected to be massaged. As illustrated by the arrows of different frequency, the user is able to apply such massaging action to any body part selected at one of high and low speeds, simply by rotating the combination massaging and actuator pad to the desired angular position.

Figure 3:
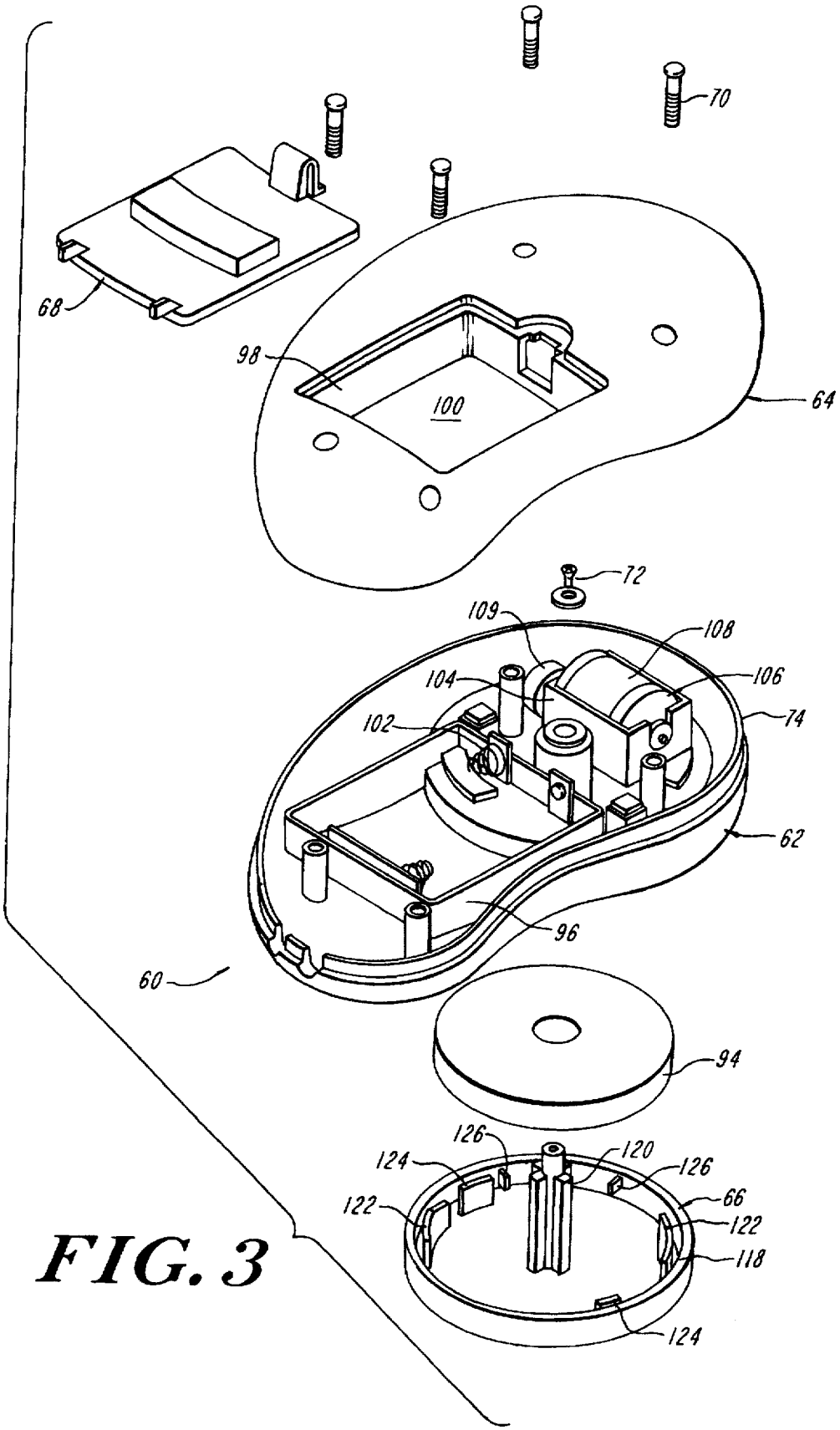
FIG. 3 is an upside-down exploded perspective view of the portable hand-held massager having combination massaging and dual function two speed actuator pad of the present invention.

Referring now to FIG. 3, generally designated at 60 is an exploded perspective view of the backside of the presently preferred embodiment of the portable hand-held massager having combination massaging and dual function two speed rotating actuator pad of the present invention. The device 60 includes mating top and bottom housing bodies generally designated 62, 64. A combination massaging and dual function two speed actuator pad generally designated 66 is rotatably and translationally mounted to the top housing body 62 and a battery cover generally designated 68 is slidably mounted to the bottom housing body 64. Threaded members 70 are provided for releasably attaching the top and bottom housing bodies together and a threaded member 72 is provided for releasably attaching the combination massaging and dual function and two speed actuator pad 66 to the top housing body 62. The top and bottom housing bodies 62, 64 respectively have a peripheral groove 74 and a peripheral tongue, not shown, which overlap in interfitting relation. The members 62, 64, 66 and 68 are preferably integrally formed, such as by injection mould and other techniques well known to those of skill in the art, which allows for economy of manufacture.

Figure 4:
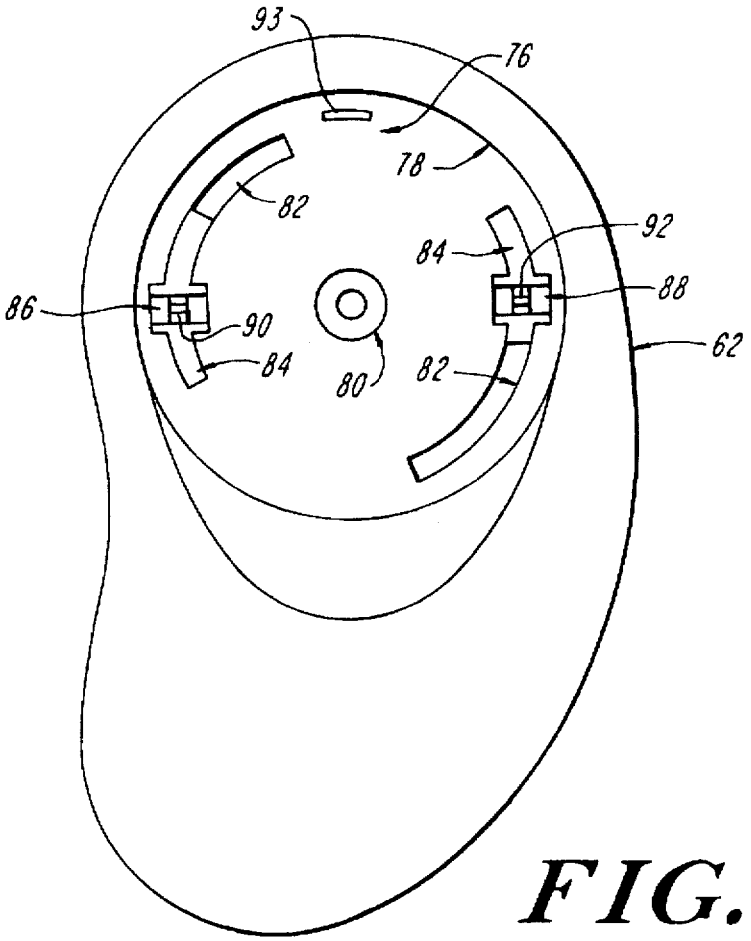
FIG. 4 is a plan view of the inside of the top housing body of the portable hand-held massager having combination massaging and dual function two speed actuator pad of the present invention.

Referring now briefly to FIG. 4, the top housing body 62 is provided with a rotary seat generally designated 76 preferably integrally formed therewith into the top face thereof. The rotary seat 76 mounts the combination massaging and actuator pad 66 (FIG. 3) for rotation about the top housing body 62 in outer and inner bearing races generally designated 78, 80. The rotary seat 76 is provided with diametrically-opposed comparatively-deep and comparatively-shallow wells generally designated 82, 84 that are integrally formed recessed therewithin. The rotary seat 76 is also provided with first and second diametrically-opposed switch receiving housings generally designated 86, 88 that are integrally formed upstanding therewith. First and second single pole single throw switches 90, 92 are received in respective switch housings 86, 88. An upstanding rotation stop and index 93 is integrally formed with the rotary seat. Although the members 82, 84, 86, 88 are formed in diametrically-opposed relation in the presently preferred embodiment, it will be appreciated that other geometries may be implemented without departing from the inventive concepts.

Returning now to FIG. 3, a flexible washer 94 of any suitable resilient material such as foamed plastic is received into the rotary seat of the top housing body 62. The flexible washer provides a resilient restoring force which acts to always urge the combination massaging and dual function and two speed actuator pad outwardly.

The top housing body 62 and the bottom housing body 64 have generally rectangularly shaped walls integrally formed therewith that are cooperative to provide a battery receiving compartment generally designated 100. In the presently preferred embodiment, two "C" batteries, not shown, are received therewithin, which mechanically and electrically contact electrodes 102 provided therefor in well-known manner. The top housing body 62 has generally rectangularly shaped walls 104 integrally formed therewith to provide a motor receiving cavity 106 generally designated and a DC motor 108 having a weight 109 eccentrically mounted to its rotary axis is mounted in the cavity 106.

Figure 5:
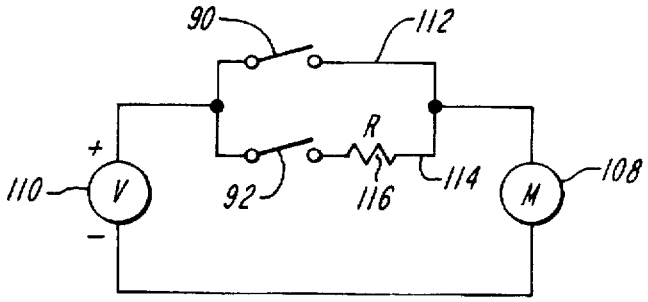
FIG. 5 is a schematic circuit diagram of the portable handheld massager having a combination massaging and dual function and two speed actuator pad in accord with the present invention.

Referring now briefly to FIG. 5, the motor 108 is electrically connected to the battery compartment electrodes and therewith to the potential source 110 marked "V" via parallel circuit paths 112, 114. The switches 90, 92 are connected in series in the parallel circuit legs 112, 114, and a resister 116 is connected in series with the switch 92 in the circuit path 114. The switches are normally in their "open" condition. When the switch 92 is actuated but not the switch 90, the motor 106 operates at a first speed determined by the voltage drop produced across the resistor 116. When the switch 90 is actuated, it shorts the path through the switch 92, and the potential applied across the motor 106 is the full potential of the voltage source 110. The motor 106 runs at a correspondingly higher speed. It will be appreciated that other circuits may be implemented without departing from the instant invention.

Returning now to FIG. 3, the combination massaging and dual function two speed actuator pad 66 has a bearing 118 integrally formed therewith, a central, depending axle 120 integrally formed therewith, diametrically-opposed cams 122 of comparatively-high profile integrally formed therewith, diametrically-opposed cams 124 of comparatively-low profile integrally formed therewith, circumferentially spaced apart and radially extending rotation stops 126 integrally formed on an inside wall of the bearing 118 to limit the angular travel thereof and five (5) grooves, not shown, spaced between the rotation stops 126 that cooperate with the rotation stop and angular position index 93 (FIG. 4) to index with a "click" sound each of the angular positions described above in connection with the description of FIGS. 1A, 1B. The pair of comparatively-high profile cams are of comparatively-longer and comparatively-shorter lengths, as are the pair of comparatively-low profile cams. The angular length and position of the comparatively-deep wells 82 (FIG. 4) corresponds to the travel and angular position of the comparatively-high profile cams 122, and provide a free space that receives the cams 122 when the pad is rotated to provide operation in the automatic mode and the pad is vertically translated. The angular length and position of the comparatively-shallow wells 84 (FIG. 4) allow the cams 122 of comparatively-high profile to readily actuate the switches during operation in the manual mode. As will be appreciated, cams of other lengths and profiles, and geometries other than diametric opposition, may be employed without departing from the inventive concepts.

In operation, as the combination massaging and actuator pad is rotated counterclockwise from its off position to select operation in the manual mode, first the shorter one of the comparatively-high profile cams depresses the switch in the circuit leg with the resistor and, with the continued angular rotation thereof, the longer one of the comparatively-high profile cams actuates the switch in the other circuit leg. Thereby, the motor is immediately caused to vibrate selectably at one of two speeds.

As the combination massaging and actuator pad is rotated clockwise from its off position to select operation in the automatic mode, first the shorter of the cams of comparatively-low profile rotates into confronting position above the switch in the circuit leg with the resistor and, with continued rotation thereof, the longer of the comparatively-low profile cams is positioned in confronting relation above the switch in the other circuit leg. At the respective clockwise angular positions, with the depression of the combination massaging and actuator pad the underlying switches are actuated by the corresponding ones of the cams of comparatively-low profile. When depressed, the cams of comparatively-high profile are received into the clearance of the comparatively-deep wells provided therefor. Thereby, the motor is caused to vibrate selectably at one of two speeds in the automatic mode.

Many modifications of the presently disclosed invention will become apparent to those skilled in the art having benefitted from the instant disclosure without departing from the inventive concepts.

What is claimed is:

1. A portable dual function massager selectably providing manual-mode operation, where the massager is "on" and is vibrating, and automatic-mode operation, where the massager is "on" and is vibrating when, and only so long as, translational actuating pressure is externally applied thereto, said massager being free from unintended actuation and undesirable user fatigue, comprising:

a handholdable housing;

an actuator member mounted to said housing for first movement relative to said housing between predetermined at least one manual-mode and at least one automatic mode position, and mounted, at each at least one automatic-mode position, to said housing for second translational movement, relative to said housing, from a predetermined nominally "off" position to a predetermined "on" position, in response to said translational actuating pressure being externally applied to said actuator member that moves it to its "on" position from its nominally "off" position when, and only so long as, said translational actuating pressure is being externally applied;

a vibratory motion imparter mounted within said handholdable housing; and an actuation mechanism means cooperative with said actuator member and electrically coupled to the vibratory motion imparter, that is responsive to said first movement of said actuator member to each at least one manual-mode position, for actuating the vibratory motion imparter to provide said manual-mode operation of said massager, where said massager is "on" and is vibrating, and that is responsive to said first movement of said actuator member to each at least one automatic-mode position, and to said second movement of said actuator member from said nominally "off" position to said "on" position, for actuating said vibratory motion imparter to provide said automatic-mode operation of said massager, where said massager is "on" and is vibrating when, and only so long as, said translational actuating pressure is externally applied.

2. The invention of claim 1, wherein said actuator member mounted for first and second movement to said housing is mounted for first movement between first and second predetermined manual-mode positions and third and fourth predetermined automatic-mode positions, and wherein said actuation mechanism means cooperative with said actuator member and electrically coupled to the vibratory motion imparter is responsive to said first movement of said actuator member to said predetermined first and second manual-mode positions thereof to actuate the vibratory motion imparter for manual-mode operation respectively at first and second speeds, and is responsive to said first movement of said actuator member to said third and fourth predetermined automatic-mode positions thereof, and to said second movement of said actuator member from said nominally "off" position to said "on" position thereof, to actuate said vibratory motion imparter for automatic-mode operation respectively at first and second speeds.

3. The invention of claim 2, wherein said first movement is rotational movement defined about an axis of rotation, said predetermined first and second and third and fourth positions are rotary positions, wherein said second movement is translational movement along said axis of rotation, and wherein said nominally "off" and said "on" positions are defined at different points along said axis of rotation.

4. The invention of claim 3, wherein said member is a combination massaging and dual function two (2) speed actuator pad rotatable and translatable about said rotational and translational axis.

5. The invention of claim 1, wherein said first movement is rotational movement defined about an axis of rotation and said second movement is translational movement defined along said axis of rotation.

6. The invention of claim 5, wherein said member is a combination massaging and dual function actuator pad rotatable and translatable about said rotational and translational axis.

7. The invention of claim 6, wherein said actuator member includes first and second cams of higher and lower profiles integrally formed therewith.

8. The invention of claim 7, wherein said first and second cams of said combination massaging and dual function actuator pad are of longer and shorter angular lengths.

9. The invention of claim 1, wherein said handholdable housing has top and bottom mating housing bodies.

10. The invention of claim 9, wherein at least one of said mating top and bottom housing bodies includes walls defining a vibratory motion imparter receiving housing.

11. The invention of claim 10, wherein said vibratory motion imparter receiving housing is integrally formed with said top housing body.

12. The invention of claim 9, wherein at least one of said mating top and bottom housing bodies includes electrodes mounted to walls providing a battery receiving compartment.

13. The invention 12, wherein said walls providing said battery compartment are formed in both the top and the bottom housing bodies.

14. The invention of claim 12, wherein said actuation mechanism includes at least one switch.

15. The invention of claim 14, wherein said actuation mechanism includes two (2) switches that are connected in parallel circuit legs between said electrodes of said battery receiving compartment and said vibratory motion imparter, and wherein a resistor is provided in one of the parallel circuit legs with one of the switches.

16. A handholdable massager selectably operable in one of a manual-mode, where the massager is "on" and is vibrating, and an automatic mode, where the massager is "on" and is vibrating when, and only so long as, translational actuating pressure is externally applied thereto, comprising:

a handholdable massager housing;

a combination massaging and dual function actuator pad mounted to said handholdable massager housing for rotation about an axis of rotation between preselected manual-mode and automatic-mode rotary positions and mounted to said handholdable massager housing for translation along said axis of rotation from an "off" to an "on" translational position by applying said external translational actuating pressure thereto that acts along said axis of rotation; and means responsive to the rotary and translational positions of said combination massaging and dual function actuator pad for selecting manual-mode operation when the same is rotated to a preselected manual-mode rotary position and for selecting automatic-mode operation when said combination massaging and dual function actuator pad is rotated to a preselected automatic-mode rotary position and is translated from said "off" translational position to said "on" translational position by said external translational actuating pressure;

whereby, the combination massaging and actuator pad both vibrates in either said manual- or automatic-modes as well as selects operation of one of said manual- and automatic-modes.

17. The invention of claim 16, wherein said manual-mode and automatic-mode rotary positions include preselected high- and low-speed manual-mode and automatic-mode rotary positions, and wherein said means for selecting manual- and automatic-mode operation selects manual-mode operation at high- and low-speed when said combination massaging and dual function actuator pad is rotated respectively to said preselected high- and low-speed manual-mode rotary positions and selects automatic-mode operation at high- and low-speed when said combination massaging and dual function actuator pad is both rotated to a respective one of said preselected high- and low-speed automatic-mode rotary positions and is translated from said "off" translational position to said "on" translational position by external pressure.

18. The invention of claim 16, wherein said means includes a switch mounted to said housing and a pair of cams of higher and lower profile depending off of said combination massaging and actuator pad at predetermined positions determined such that said higher profile cam actuates said switch when said combination massaging and actuator pad is rotated to said manual-mode rotary position and said lower profile cam confronts said switch when said combination massaging and actuator pad is rotated to said automatic-mode rotary position.

19. The invention of claim 17, wherein said means includes first and second switches mounted to said housing and first and second pairs of cams of higher and lower profile depending off of said combination massaging and actuator pad at predetermined positions determined such that one of said higher profile cams actuates one of said switches when said combination massaging and actuator pad is rotated to one of said high- and low-speed manual-mode rotary positions and the other one of said higher profile cams contacts the other one of said switches when said combination massaging and actuator pad is rotated to the other one of said high- and low-speed manual-mode rotary positions and determined such that one of said lower profile cams confronts one of said switches when said combination massaging and actuator pad is rotated to one of said high- and low-speed automatic-mode rotary positions and the other one of said lower-profile cams confronts the other one of said switches when said combination massaging and actuator pad is rotated to the other one of said high- and low-speed automatic-mode rotary positions.

* * * * *